United States Patent [19]

Palmer

[11] Patent Number: 4,993,086

[45] Date of Patent: Feb. 19, 1991

[54] EMERGENCY SHUT-OFF MECHANISM FOR FLUSH TANK

[76] Inventor: Willice C. Palmer, 2446 Crestline Dr., Oceanside, Calif. 92054

[21] Appl. No.: 568,786

[22] Filed: Aug. 17, 1990

Related U.S. Application Data

[63] Continuation-in-part of Ser. No. 390,639, Aug. 7, 1989, abandoned.

[51] Int. Cl.[5] ..... E03D 1/00

[52] U.S. Cl. ..... 4/363; 4/415; 137/400; 137/423

[58] Field of Search ..... 4/363, 364, 392, 393, 4/415, 365, 366, 367; 137/400, 421, 423

[56] References Cited

U.S. PATENT DOCUMENTS

| | | | |
|---|---|---|---|
| 1,787,379 | 12/1930 | Hewitt | 137/423 |
| 2,139,616 | 12/1938 | Foulds | 137/423 X |
| 2,320,457 | 6/1943 | Hammell | 137/400 |
| 2,841,169 | 7/1958 | Martin et al. | 137/400 |
| 3,574,867 | 4/1971 | Biniores | 4/363 |
| 3,626,520 | 12/1971 | Biniores | 4/363 |
| 3,693,649 | 9/1972 | Gordon et al. | 137/432 X |
| 4,110,849 | 9/1978 | La Faver | 4/415 X |
| 4,399,835 | 8/1983 | Holderith | 137/433 X |
| 4,881,279 | 11/1989 | Harney | 4/415 X |
| 4,901,377 | 2/1990 | Weir | 4/415 |

FOREIGN PATENT DOCUMENTS

| | | | |
|---|---|---|---|
| 94699 | 9/1896 | Fed. Rep. of Germany | 4/364 |

*Primary Examiner*—Henry J. Recla
*Assistant Examiner*—Robert M. Fetsuga
*Attorney, Agent, or Firm*—Calif K. Tervo

[57] ABSTRACT

An emergency shut-off for a flush tank having a liquid replenishment valve is connected to the liquid replenishment valve for moving the valve to a closed position if liquid level in the tank has not reached a predetermined height within a predetermined time after the tank has been flushed. Broadly speaking, the emergency shut-off comprises a container, a buoy, and a valve connection mechanism. The container extends downward in the tank from at least the predetermined height and includes a valve for allowing liquid in the tank to enter the container and for allowing liquid within the container to egress into the tank at a predetermined rate. The buoy in the container raises and lowers with the liquid level in the container and contacts the valve connection mechanism when the liquid in the container is at a predetermined shut-off height. The valve connection mechanism is connected to the valve for closing the valve in response to contact by the buoy.

6 Claims, 2 Drawing Sheets

FIG. 1
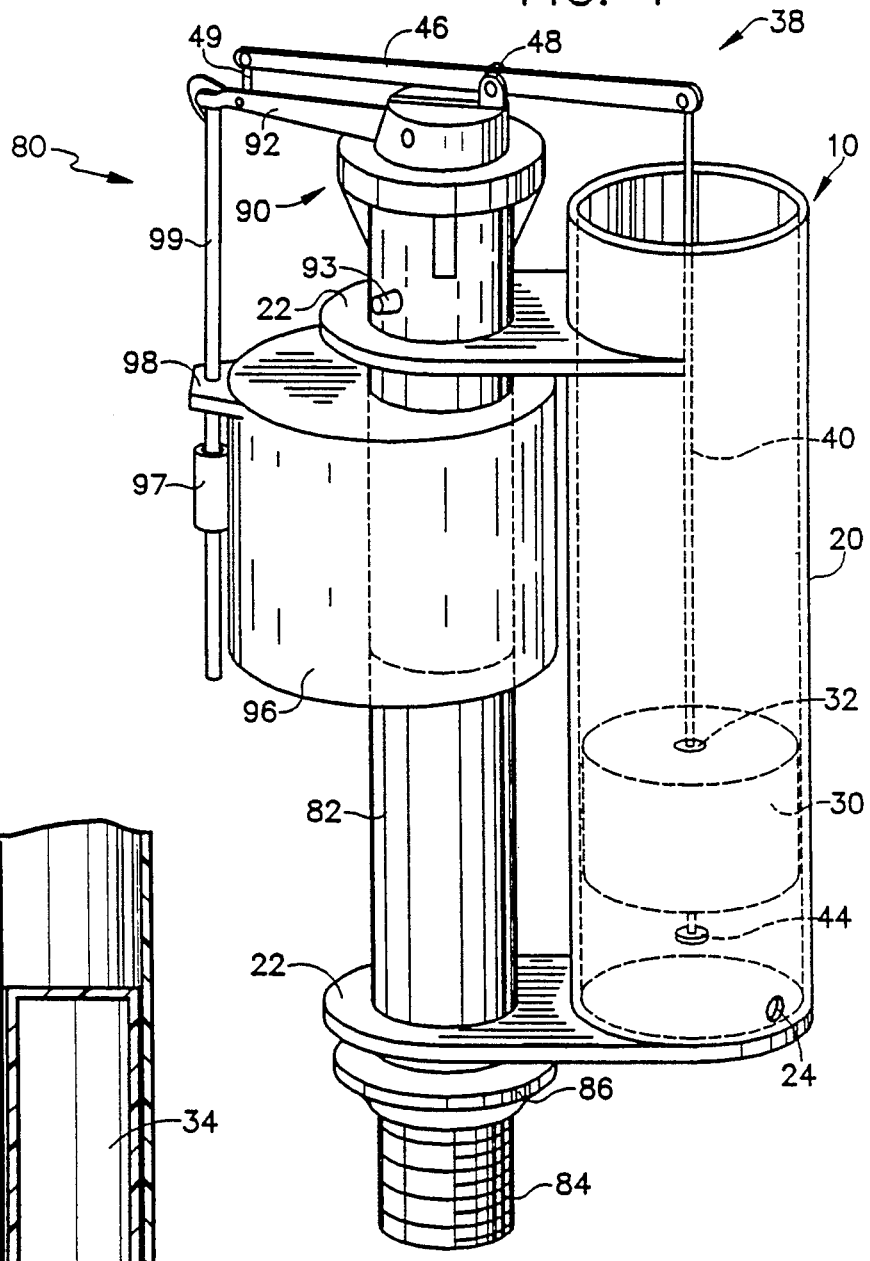
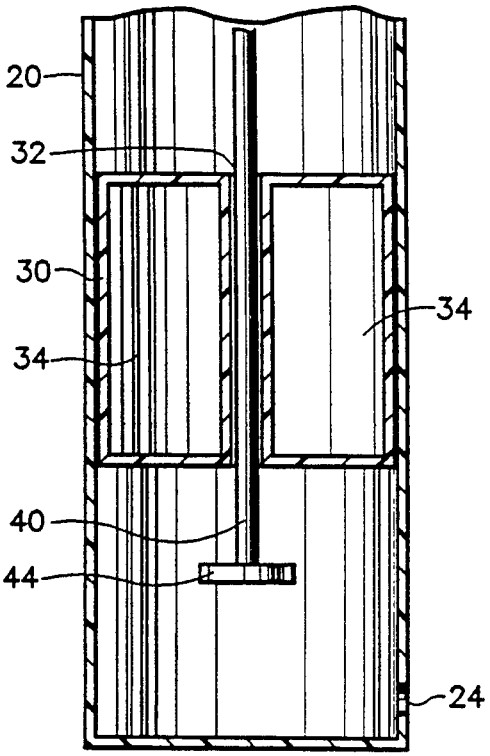
FIG. 2

FIG. 3
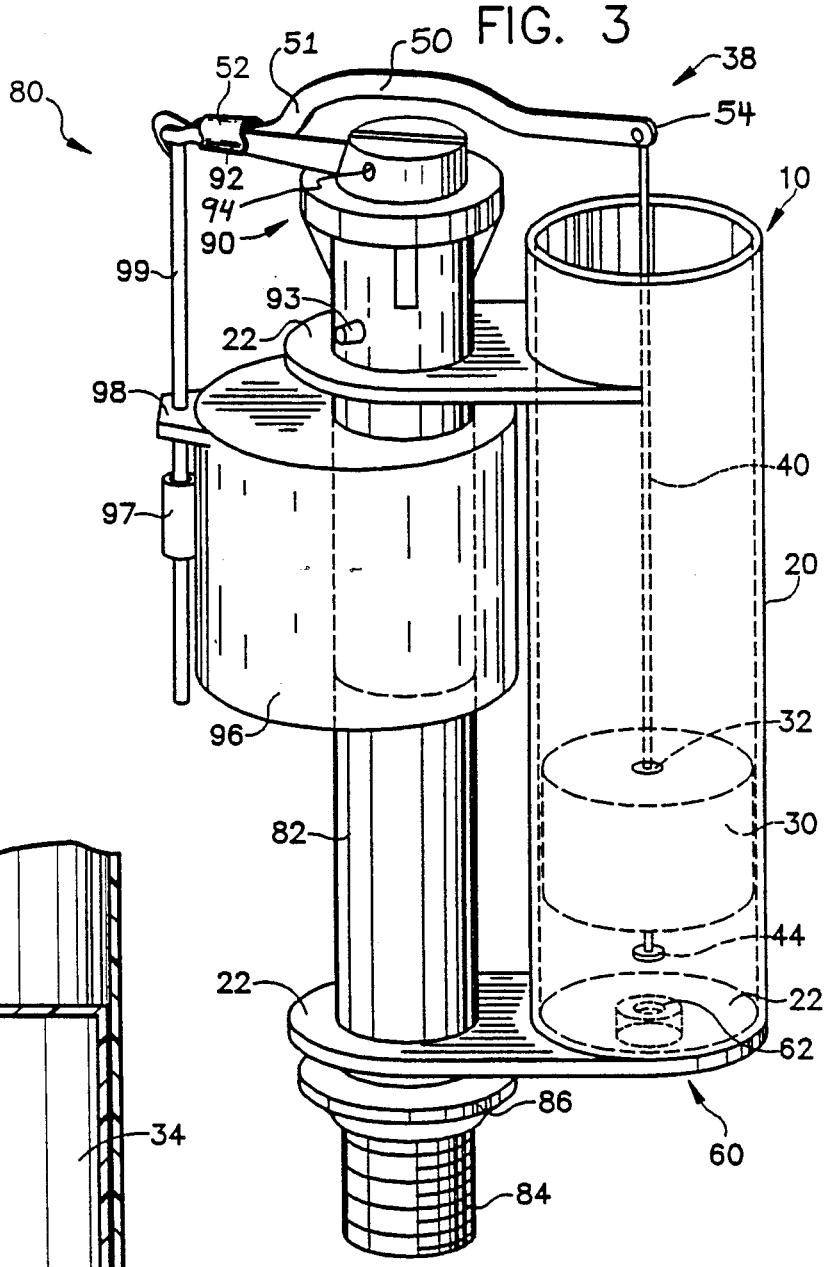
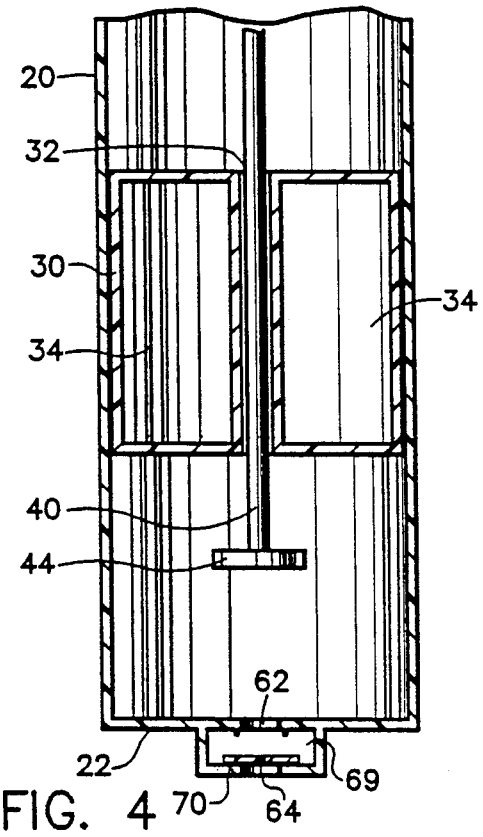
FIG. 4
FIG. 5
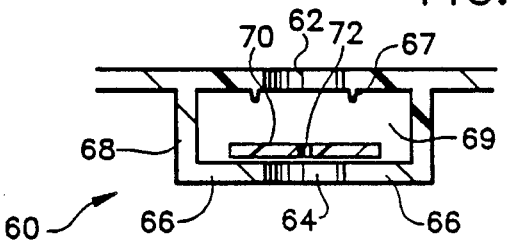

EMERGENCY SHUT-OFF MECHANISM FOR FLUSH TANK

This application is a continuation-in-part of application Ser. No. 390,639, filed Aug. 7, 1989, now abandoned.

FIELD OF THE INVENTION

This invention relates in general to an emergency shut-off mechanism for a flush tank and more specifically involves a mechanical device for closing the liquid replenishment valve upon failure of the flush valve.

BACKGROUND OF THE INVENTION

Many times and for many reasons, the automatic closure mechanism, generally a flush valve, in the floor of a toilet fails to close or fails to close completely. The automatic closure mechanism fails for reasons such as worn out or deteriorated closure mechanism (flush valve or flapper); stuck flush handle; tangled chain or linkage; or faulty hinge on flush valve.

Quite often the user has left the vicinity and is unaware of flush mechanism failure.

This results in a continuous flow of water through the replenishment valve from the main supply to the flush tank and out the drain. The water is wasted until the flush valve is manually closed or the main water supply is manually cut off.

Due to the above circumstances a phenomenally large amount of water is wasted daily.

Therefore, there has been a need for an automatic shut-off mechanism for the replenishment valve of flush tanks upon flush valve failure.

It is desirable that such an automatic shut-off mechanism adapt easily to toilet environment and construction.

It is further desirable that such a mechanism be capable of retrofit on existing toilet refill mechanisms.

SUMMARY OF THE INVENTION

According to the invention, an emergency shut-off for a flush tank having a liquid replenishment valve is connected to the liquid replenishment valve for moving the valve to a closed position if liquid level in the tank has not reached a predetermined height within a predetermined time after the tank has been flushed. Broadly speaking, the emergency shut-off comprises a valve connection lever, a container, a buoy, and a vertical activation rod. The container is disposed in the tank at least to the predetermined height and includes a liquid ingress and discharge hole for allowing liquid in the tank to enter the container and for allowing liquid within the container to egress into the tank at a predetermined rate. The buoy in the container raises and lowers with the liquid level in the container and contacts and depresses the vertical activation rod when the liquid in the container is at a predetermined height. The vertical activation rod in turn depresses one end of the valve connection lever thereby closing the liquid replenishment valve.

In a preferred embodiment, the valve connection lever is attached at one end to the float lever of a conventional refill valve and is cantilevered over the top of the valve. The buoy includes a vertical bore therethrough. The vertical activation rod is freely journaled in the buoy bore and has a top end attached to the free end of the valve connection lever and an end cap disposed below the buoy. The end cap is not able to pass through the buoy bore. Therefore, the buoy may move up and down dependant upon the fluid level in the container and may move freely up the rod and may move down until encountering the end cap. Further downward movement of the buoy depresses the rod thereby depressing the cantilevered lever free end and closing the replenishment valve.

A valve in the container wall controls the rates of liquid ingress and egress to the container.

Other features and many attendant advantages of the invention will become more apparent upon a reading of the following detailed description, together with the drawings wherein like reference numerals refer to like parts throughout.

The drawings disclose by way of example, and not by way of limitation, the principles of the invention and structural implementations of the inventive concept.

BRIEF DESCRIPTION OF THE DRAWING

FIG. 1 is a perspective view of a conventional toilet flush tank ball cock assembly with an embodiment of the emergency shut-off mechanism of the present invention attached thereto.

FIG. 2 is an enlarged sectional view of the major components of the container, buoy, and activation rod of FIG. 1.

FIG. 3 is a perspective view of a conventional toilet flush tank ball cock assembly with a alternate preferred embodiment of the emergency shut-off mechanism of the present invention attached thereto.

FIG. 4 is an enlarged sectional view of the major components of the container, buoy, and activation rod of FIG. 3.

FIG. 5 is a further enlarged, cross-sectional view of the container valve of FIG. 4.

DETAILED DESCRIPTION OF THE INVENTION

With reference now to the drawing, and more particularly to FIG. 1 thereof, there is shown a preferred embodiment the emergency shut-off mechanism, denoted generally as 10, of the present invention attached to a conventional toilet ball cock assembly, denoted generally as 80. These devices are located in a flush tank, not shown.

The ball cock assembly 80 shown is typical of the water replenishment apparatus in a toilet flush tank. The lower end of the standing pipe 82 passes through a hole in the bottom of the tank, not shown. Cone-shaped washer 86 seals the hole from the inside. The threaded water inlet end 84 passes through the tank wall and is held with a lock washer, not shown. A water supply tube, not shown, for supplying water under pressure from the plumbing system, is attached to threaded inlet end 84 with a coupling nut, not shown. In this manner standing pipe 82 is supplied with pressurized water.

At the top end of standing pipe 82 is a valve assembly, denoted generally as 90, containing the ball cock valve, not shown. Valve control arm 92 is connected to the valve and pivots about pin 94. When the valve control arm outer end is lowered, the valve opens and releases water into the tank from openings around the valve assembly 90. Valve control arm 92 is typically biased to the raised position such that absent external forces the valve is closed. A refill tube fitting 93 supplies water to a tube attached thereto to supply water to the toilet bowl after flush to raise the water level in the trap for an adequate seal.

Float cup 96, journaled on standing pipe 82, can move up and down along standing pipe 82. Float cup 96 is buoyant and attempts to move up and down in in accordance with the fluid level in the tank. Float cup rod 99 connects float cup 96 to valve control arm 92. Float cup 96 includes rod guide 97 which has a vertical bore through which cup rod 96 passes and adjustment clip 98 for positively attaching float cup 96 to cup rod 99 and for selectively adjusting the vertical positioning of float cup 96 on cup rod 96.

When the tank is flushed, float cup 96 is no longer buoyed and drops such that cup rod 99 pulls down on outer end of valve control arm 92 thereby opening the valve and releasing replenishment water into the tank. As this replenishment water refills the tank, float cup 96 is eventually re-floated whereby the valve is closed.

In this conventional model, if the flush valve remains open or does not seat properly, then the replenishment water will continue to enter the tank. Water will continue to enter the tank at either the maximum rate allowed by the valve or by the rate of leakage until the flush valve is properly seated.

Applicant's emergency shut-off mechanism 10 closes the ball cock valve in the event of leakage after flushing. The emergency shut-off mechanism 10 of FIG. 1 includes a container 20 which extends downward in the tank. Container 20 is rigidly held in place by any suitable means, such as by brackets 22 connected to standing pipe 82. Container 20 may be made of any material capable of holding water but is preferably of plastic or another material compatible with the materials in the ball cock assembly 80 so as to not cause electrolysis. The top of container 20 is open to allow displaced air to escape. Container 20 includes fluid ingress means and fluid discharge means, such as discharge hole 24, for allowing water from the tank to enter and leave the container 20. Although only one hole 24 is shown, it will be apparent that the desired results can be achieved in a variety of manners including a plurality of holes.

A buoy 30 is disposed within container 20. Valve connection mechanism means, denoted generally as 38, includes a vertical activation means, such as shut-off rod 40, lever arm 46, pivot 48, and short arm 49.

Buoy 30 moves up and down according to the fluid level within the container 20. Shut-off rod 40 passes through central vertical sleeve 32 in buoy 30 and terminates in end cap 44. As best seen in FIG. 2, buoy 30 includes buoyant chambers 34 and a central vertical shaft 32 through which the shut-off rod 40 passes. Buoy 30 is freely journaled on shut-off rod 40 and can move upward without rod movement and can move downward without rod movement until encountering end cap 44 of shut-off rod 40.

Returning once more to FIG. 1, the top of shut-off rod 40 is hingedly connected to one end of lever arm 46. Lever arm 46 is pivotally connected to pivot 48 on top of the ball cock assembly 80. The other end of lever 46 is hingedly connected to short arm 49 which is hingedly connected to valve control arm 92.

The emergency shut-off mechanism functions as follows. When the tank is at its maximum water level, the container also contains water to the same level because the water enters through discharge hole 24. At this time both float cup 96 and buoy 30 float on the same level of water.

When the tank is flushed, the water is quickly emptied and float cup 96, being no longer buoyed, drops, thereby pulling down on valve arm 92 which opens the valve to release replenishment water into the tank. The size of discharge hole 24 determines the rate at which water empties from container 20 and, consequently, the rate at which buoy 30 drops in container 20. If the flush valve does not close, so that the tank cannot refill, then container 20 will continue to drain.

As best seen in FIG. 2, as container 20 drains, buoy 30 eventually encounters shut-off rod end cap 44 of valve connection mechanism means 38 and moves it downward whereby valve connection mechanism means 38 raises valve control arm 92 closing the valve. In the embodiment shown, where the valve connection mechanism means is connected to the same valve control arm 92 as is float cup 96, then the weight of buoy 30 and the leverage of valve connection mechanism means 38 must be sufficient to overcome the weight of float cup 96 in order to raise valve control arm 92 and shut the valve. In this manner, if the tank will not hold water, the emergency shut-off mechanism 10 of the invention shuts-off the supply of incoming water.

In the appended claims, the height of buoy 30 when it causes the valve to close is referred to as the "shut-off height" and the time taken for container 20 to drain so that buoy 30 reaches this shut-off height is referred to as the "shut-off time". The size and location of the fluid discharge means, such as discharge hole 24, determines the shut-off time. Discharge hole 24 must be located sufficiently low to permit buoy 30 to reach shut-off height.

FIGS. 3–5 illustrate an alternate preferred embodiment of the flush tank emergency shut-off mechanism of the invention. FIG. 3 is a perspective view of a conventional toilet flush tank ball cock assembly with the alternate preferred embodiment of the emergency shut-off mechanism 10 of the present invention attached thereto. FIG. 4 is an enlarged sectional view of the major components of the container 20, buoy 30, and activation rod 40 of FIG. 3. FIG. 5 is a further enlarged, cross-sectional view of the container valve 60 of FIG. 4.

With reference now to FIG. 3, valve connection mechanism means 38 includes a cantilevered lever 50 having a first end 51 fastened to valve control arm 92 and having a second end 54 disposed above container 20. Cantilevered lever 50 lies parallel to valve control arm 92, passes over the valve pivot pin 94, and is securely fastened to valve control arm 92 by suitable means, such as clip 52, such that downward movement of second end 54 raises valve control arm 92 to close the valve.

A vertical activation means, such as rod 40, depresses lever second end 54 to close the valve when float 30 depresses rod 40. In the preferred embodiment illustrated, float 30 is freely journaled on rod 40 and the upper end of rod 40 is attached to the second end of cantilevered lever 50. Other constructions for the vertical activtiot means are also possible. For example, rod 40 could be attached to float 30 and the upper end of rod 40 could be free journaled through an oriface in second end 54 of cantilever lever 50.

A valve means, denoted generally as 60, is disposed in the bottom of container 20 and controls the liquid ingress and egress of container 20. Valve 60 regulates liquid ingress such that the liquid level in container 20 approximates the level in the flush tank and regulates the egress such that, following flushing, the liquid level in container is above that of the flush tank. Since container 20 fills at the same rate as the flush tank, the egress rate determines the time lapse to shut off the valve after flushing if the fluid level has not reached the predetermined height.

Valve 60 includes an upper passage 62 through the container bottom wall, walls 66, 68 defining a chamber 69 adjoining passage 62, and valve disk 70 disposed within the chamber 69. Chamber bottom wall 66 has a lower passage 64 therethrough. Disk 70 has an egress passage 72 therethrough. Upper passage 62 and lower passage 64 are larger and permit greater liquid flow than egress hole 72.

Upon liquid egress from container 20, disk 70 lies against bottom wall 66 such that egress passage 72 is disposed over lower passage 64 and the outer portions of disk 70 seal of the remainder of lower passage 64 so that liquid egress is only through the smaller disk egress passage 72. When the liquid level in the flush tank is higher than the liquid level in container 20, liquid pressure will raise disk 70 such that liquid will ingress through lower passage 64, around disk 70, and through upper passage 62.

A plurality of projections 67 within chamber 69 disposed around the periphery of upper passage 62 prevent disk 70 from blocking upper passage 62 upon rapid liquid ingress and allow flow around disk 70 and through upper passage 62. Disk 70 is made of material, such as plastic, such that it will sink in the liquid and will cover lower passage 64 in the static situation and upon liquid egress but is light enough so that it will be easily raised by ingressing liquid to permit the free flow thereof.

Although particular embodiments of the invention has been illustrated and described, various changes may be made in the form, construction, and arrangement of the parts herein while still functioning under the same general principles of the invention and without sacrificing any of its advantages. For example, the valve connection mechanism means may be constructed in many forms and perform the function of shutting-off incoming water in response to the buoy reaching a shut-off height. Also, although the invention has been described with respect to a common household toilet using water, it is applicable to any flush tank of similar design and using another liquid, such as are used in many commercial applications.

Therefore, it is to be understood that all matter herein is to be interpreted as illustrative and not in any limiting sense, and it is intended to cover in the appended claims such modifications and changes as come within the true spirit and scope of the invention.

Having described my invention, I now claim:

1. Emergency shut-off means for connection to a valve activation lever of a liquid replenishment valve of a flush tank for moving the valve to a closed position if liquid level has not risen to a predetermined height within a predetermined shut-off time after the tank has been flushed; said emergency shut-off means comprising:

replenishment valve connection mechanism means including a rigid lever having a first end and a second end; said first end for connection to the liquid replenishment valve activation lever such that when said second end is depressed the liquid replenishment valve is closed;

container means for disposition in the flush tank including:

valve means for controlling ingress of tank liquid into said container such that during tank filling the liquid level in said container approximates that of the flush tank and for controlling liquid egress from said container at a predetermined rate such that following flushing the liquid level in said container is above that of the flush tank;

buoy means disposed in said container means for moving up and down dependent upon the liquid level in said container means; said buoy means when in a down position defining a predetermined shut-off height; and vertical activation means connected to said buoy means and said second end of said rigid lever for depressing said second end of said rigid lever thereby closing the valve in response to said buoy means reaching the predetermined shut-off height.

2. The emergency shut-off means of claim 1 wherein:

said rigid lever is adapted to be connected in cantilevered relation to the activation lever.

3. The emergency shut-off valve of claim 1 wherein:

said buoy means includes a vertical bore therethrough; and said vertical activation means includes a rod freely journaled through said vertical bore;

said rod including an end cap disposed below said buoy; said end cap not being able to pass through said bore.

4. The emergency shut-off valve of claim 1 wherein:

said container includes an external wall; and said valve means includes:

wall means attached to said container wall and defining a chamber abutting said container wall;

an upper passage means through said container wall abutting said chamber for providing fluid communication between said chamber and the inside of said container;

a lower passage means through said wall means for providing fluid communication between said chamber and the flush tank; and valve disk means movable within said chamber for at least partially closing said lower passage means during liquid egress from said container means for slowing and regulating said egress.

5. In a flush tank having a liquid replenishment valve and a valve activation lever for controlling the valve, an emergency shut-off means connected to the activation lever for moving the valve to a closed position if liquid level has not risen to a predetermined height within a predetermined shut-off time after the tank has been flushed; said emergency shut-off means comprising:

rigid lever means having:

a first end; and a second end;

said first end connected to the activation lever of the liquid replenishment valve such that depressing said second end closes the liquid replenishment valve;

container means disposed in the flush tank including:

liquid ingress and discharge means for allowing liquid in the tank to enter said container means and for allowing liquid within said container means to egress into the tank at a predetermined rate such that following flushing the liquid level in said container is above that of the flush tank;

buoy means disposed in said container means, such that said buoy means moves up and down with the liquid level in said container means; said buoy means when in a down position defining a predetermined shut-off height; and vertical activation means connected to said buoy means and said second end of said lever means for depressing said second end of said lever means thereby closing the valve in response to said buoy means reaching the predetermined shut-off height.

6. The emergency shut-off valve of claim 5 wherein:

said container includes an external wall; and said liquid ingress and discharge means includes:

wall means attached to said container wall and defining a chamber abutting said container wall;

an upper passage means through said container wall abutting said chamber for providing fluid communication between said chamber and the inside of said container;

a lower passage means through said wall means for providing fluid communication between said chamber and the flush tank; and valve disk means movable within said chamber for at least partially closing said lower passage means during liquid egress from said container means for slowing and regulating said egress.

* * * * *